US011999535B2

(12) United States Patent
Zhu

(10) Patent No.: US 11,999,535 B2
(45) Date of Patent: Jun. 4, 2024

(54) MATERIAL LOADING DEVICE

(71) Applicant: TRIPLE WIN TECHNOLOGY(SHENZHEN) CO. LTD., Shenzhen (CN)

(72) Inventor: Cong Zhu, Shenzhen (CN)

(73) Assignee: TRIPLE WIN TECHNOLOGY(SHENZHEN) CO. LTD., Shenzhen (CN)

( * ) Notice: Subject to any disclaimer, the term of this patent is extended or adjusted under 35 U.S.C. 154(b) by 622 days.

(21) Appl. No.: 17/208,016

(22) Filed: Mar. 22, 2021

(65) Prior Publication Data

US 2022/0219868 A1 Jul. 14, 2022

(30) Foreign Application Priority Data

Jan. 13, 2021 (CN) ..... 202120086216.X

(51) Int. Cl.

| | |
|---|---|
| ***B65D 45/28*** | (2006.01) |
| ***B65D 25/10*** | (2006.01) |
| ***B65D 25/28*** | (2006.01) |
| ***B65D 51/24*** | (2006.01) |

(52) U.S. Cl.

CPC ..... *B65D 45/28* (2013.01); *B65D 25/107* (2013.01); *B65D 51/248* (2013.01); *B65D 25/2858* (2013.01); *B65D 2203/12* (2013.01); *B65D 2251/1016* (2013.01); *B65D 2555/02* (2013.01)

(58) Field of Classification Search

CPC ..... B65D 25/10; B65D 25/107; B65D 25/24; B65D 25/28; B65D 25/2858; B65D 45/28; B65D 51/248; B65D 85/30; B65D 2203/12; B65D 2251/1016; B65D 2555/02

USPC ..... 206/459.1, 564

See application file for complete search history.

(56) References Cited

U.S. PATENT DOCUMENTS 8,342,580 B2 * 1/2013 Cowie ..... B65D 43/22 292/148

10,842,125 B1 * 11/2020 Christian ..... A01K 1/0058

* cited by examiner

*Primary Examiner* — Bryon P Gehman

(74) *Attorney, Agent, or Firm* — ScienBiziP, P.C.

(57) ABSTRACT

A material loading device includes a main body defining a receiving cavity and an opening. The receiving cavity receives materials. The main body defines a buckle groove at the opening. A buckle rod movably coupled to the main body at the opening buckles into the buckle groove. A foolproof mechanism is arranged on the main body. A thimble of the foolproof mechanism is slidably coupled to the main body. One end of the thimble is located in the buckle groove. When the buckle rod is buckled into the buckle groove, the buckle rod drives the thimble to slide relative to the main body. A display member of the foolproof mechanism is coupled to the thimble. The main body defines a plurality of recesses corresponding to the display member. The thimble drives the display member to slide relative to the recesses to switch the display member displayed through the recesses.

11 Claims, 5 Drawing Sheets

MATERIAL LOADING DEVICE

FIELD

The subject matter herein generally relates to material transporting mechanisms, and more particularly to a material loading devices.

BACKGROUND

In production processes, raw materials are generally transported in a loading box. The loading box generally uses a mechanical buckle. However, when the raw material is loaded into the loading box, the buckle may not easily be located by an operator when the buckle is not engaged. If the operator forgets to engage the buckle, the raw materials in the loading box may fall out during transportation.

BRIEF DESCRIPTION OF THE DRAWINGS

Implementations of the present disclosure will now be described, by way of embodiments, with reference to the attached figures.

DETAILED DESCRIPTION

Figure 1:
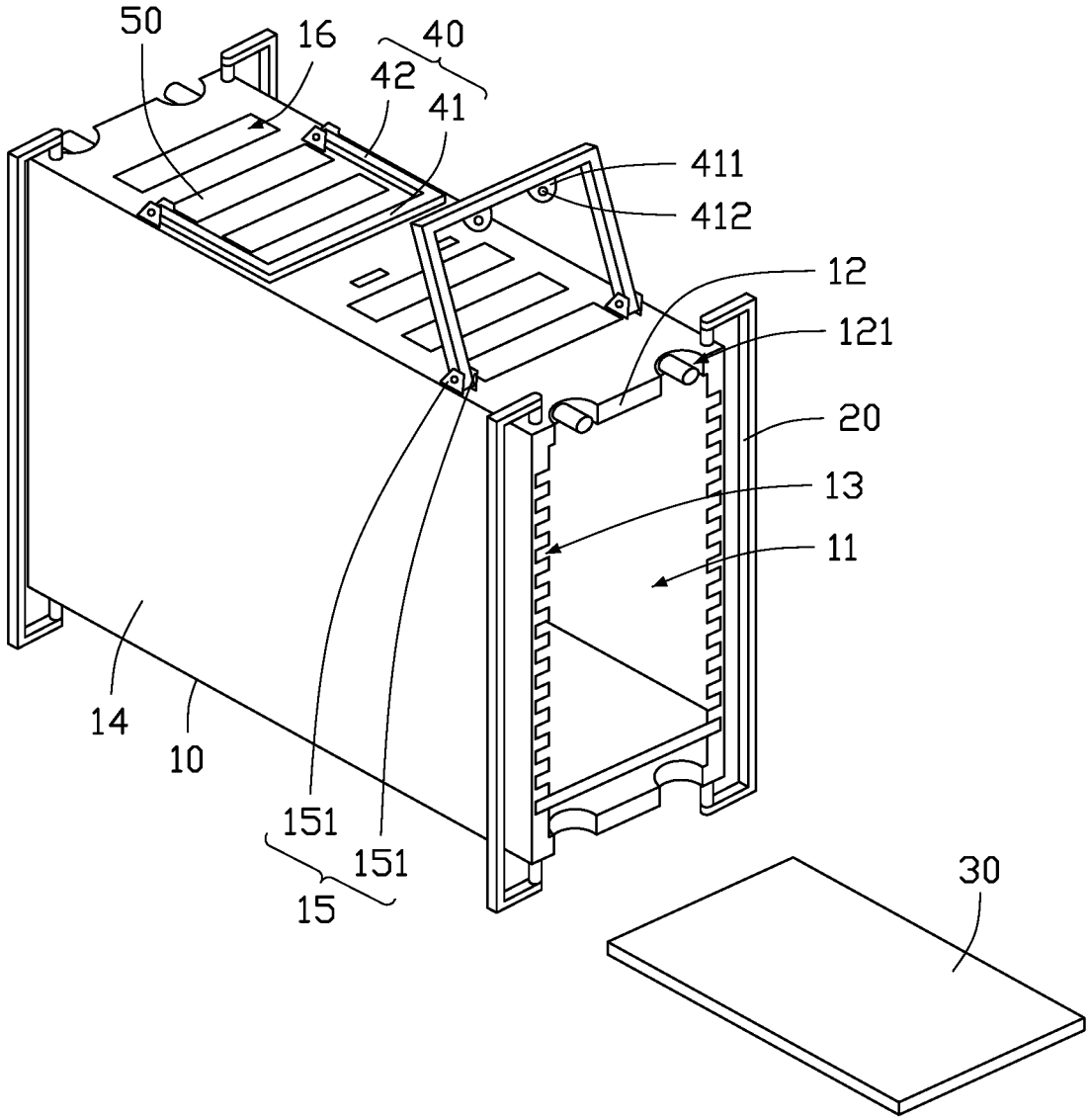
FIG. 1 is a schematic perspective diagram of an embodiment of a material loading device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or another word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series, and the like.

FIG. 1 shows an embodiment of a material loading device. The material loading device 100 is used to hold and fix materials in place, and the materials are transported in the material loading device 100.

The material loading device 100 includes a main body 10 and a buckle rod 20. The main body 10 is provided with a receiving cavity 11 and at least one opening 12 communicating with the receiving cavity 11. The receiving cavity 11 receives the materials. The buckle rod 20 is movably coupled to the main body 10 at the opening 12. The main body 10 further defines a buckle groove 121 at the opening 12. The buckle rod 20 is configured to buckle into the buckle groove 121 to prevent the material in the receiving cavity 11 from falling out of the opening 12. In one embodiment, each buckle rod 20 corresponds to two buckle grooves 121. Two ends of the buckle rod 20 are respectively buckled into two buckle grooves 121, so that the buckle rod 20 is buckled stably, thereby improving the effect of the buckle rod 20 preventing the materials in the receiving cavity 11 from falling out.

The material loading device 100 further includes a plurality of loading plates 30, which are used to carry materials. Two opposite inner walls of the main body 10 define a plurality of slots 13. Two sides of each of the loading plates 30 are respectively inserted into the corresponding slots 13 on the two opposite inner walls, and the buckle rod 20 is used to resist against the loading plates 30 inserted into the slots 13. The loading plates 30 received in the slots 13 facilitate fixed parallel arrangement of the materials on the loading plates 30 in the receiving cavity 11.

In one embodiment, the main body 10 is substantially a rectangular parallelepiped structure formed by four walls 14. The main body 10 defines two oppositely arranged rectangular openings 12, and the loading plates 30 can be inserted or removed through the two openings 12. The main body 10 includes four buckle rods 20, and two buckle rods 20 are provided at each opening 12. Correspondingly, four buckle grooves 121 are defined at each opening 12, and two buckle grooves 121 correspond to one buckle rod 20.

The material loading device 100 further includes a handle mechanism 40. The handle mechanism 40 includes a handle 41 and two connecting rods 42 respectively coupled to two ends of the handle 41. An outer side of one wall 14 of the main body 10 is provided with at least two connecting seats 15 facing each other. An end of each connecting rod 42 away from the handle 41 is rotationally coupled to the corresponding connecting seat 15. The handle 41 is rotationally coupled to the main body 10 through the connecting rods 42 to facilitate lifting the main body 10.

Figure 2:
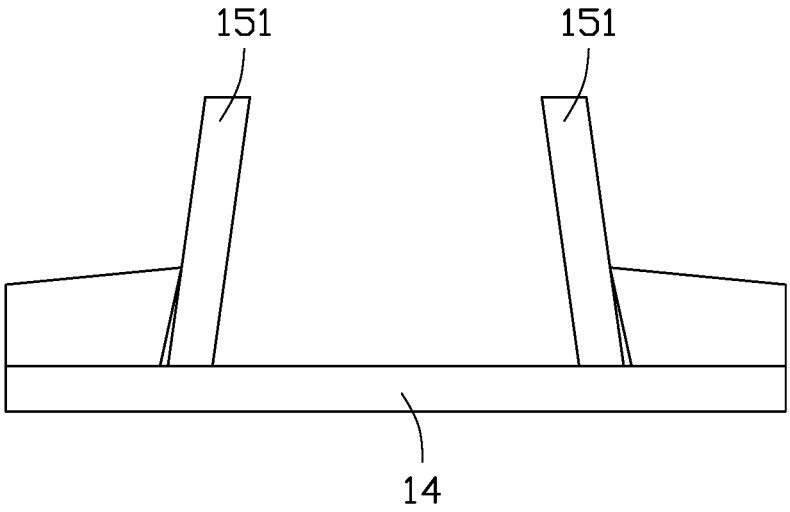
FIG. 2 is a schematic diagram of a structure of a connecting seat in the material loading device.

Referring to FIG. 2, each connecting seat 15 includes two clamping plates 151 arranged at an angle, and a distance between the two clamping plates 151 gradually decreases along a direction from a surface of the main body 10 to away from the main body 10. A force on the connecting rod 42 rotationally coupled between the two clamping plates 151 gradually increases from the surface of the main body 10 to away from the main body 10, so that when an external force is not applied to the handle 41, the handle 41 falls to the surface of the main body 10. When the handle 41 falls to the surface of the main body 10, a buckle portion 411 of the handle 41 is received into a groove 142 defined in the surface of the corresponding wall 14.

In one embodiment, each connecting rod 42 is provided with a shaft, each clamping plate 151 is provided with a rotating hole, and the shaft of the connecting rod 42 passes through the rotating holes, so that the connecting rod 42 is rotationally coupled between the two clamping plates 151. In one embodiment, an angle between each clamping plate 151 and the surface of the main body 10 is 85°.

The material loading device 100 further includes a foolproof mechanism 50. The foolproof mechanism 50 is provided on the main body 10 to indicate a buckling state of the buckle rods 20. When the buckle rods 20 are not buckled into the buckle grooves 121, the foolproof mechanism 50 latches the handle 41 so that the handle 41 cannot be lifted, which prevents an operator from forgetting to buckle the buckle rods 20, thereby preventing the carrier plates 30 from falling out during transportation. In one embodiment, the foolproof mechanism 50 is located in the corresponding wall 14 of the main body 10. In another embodiment, the foolproof mechanism 50 may be provided on a side of a corresponding wall 14 facing the receiving cavity 11 through the loading plate 30.

In the material loading device 100, the buckle rods 20 are buckled into the buckle grooves 121 to resist against the material loading plates 30 inserted into the slots 13, thereby stably holding the materials on the loading plates 30. The two clamping plates 151 drive the connecting rod 42 rotationally coupled between the two clamping plates 151 to drive the handle 41 to fall to the surface of the main body 10 without external force, so as to facilitate the foolproof mechanism 50 latching the handle 41. The foolproof mechanism 50 is used to indicate the buckling state of the buckle rods 20. When the buckle rods 20 are not buckled into the buckle grooves 121, the foolproof mechanism 50 latches the handle 41 so that the handle 41 cannot be lifted, which prevents an operator from forgetting to buckle the buckle rods 20, thereby preventing the carrier plates 30 from falling out during transportation.

Figure 3:
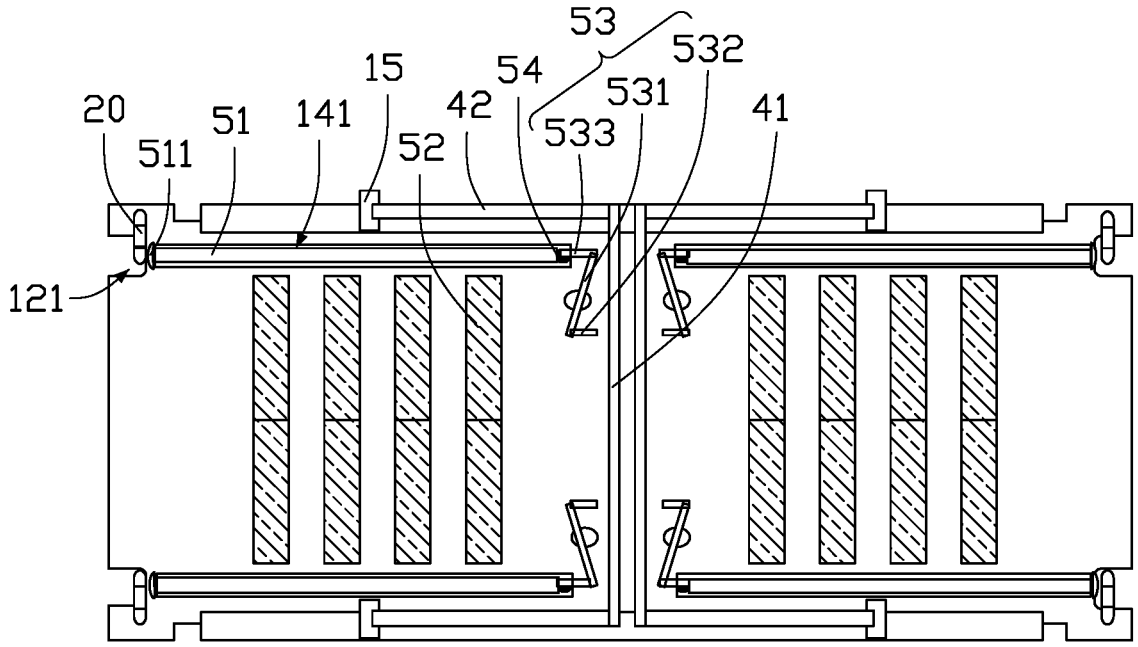
FIG. 3 is a schematic diagram of a structure of a foolproof mechanism when the material loading device is not buckled.

FIG. 3 shows a structure of the foolproof mechanism 50 when the material loading device 100 is not buckled. The foolproof mechanism 50 includes a thimble 51 and a display member 52. The thimble 51 is slidably coupled to the main body 10. One end of the thimble 51 is located in the buckle groove 121. When the buckle rod 20 is buckled into the buckle groove 121, the buckle rod 20 drives the thimble 51 to slide relative to the main body 10. In one embodiment, a sliding channel 141 communicating with the buckle groove 121 is defined in the corresponding wall 14, and the thimble 51 is slidably received in the sliding channel 141 to improve a sliding stability of the thimble 51.

In one embodiment, the end of the thimble 51 located in the buckle groove 121 includes a limiting portion 511. The limiting portion 511 protrudes radially outward to limit a sliding distance of the thimble 51 in the sliding channel 141.

Figure 4:
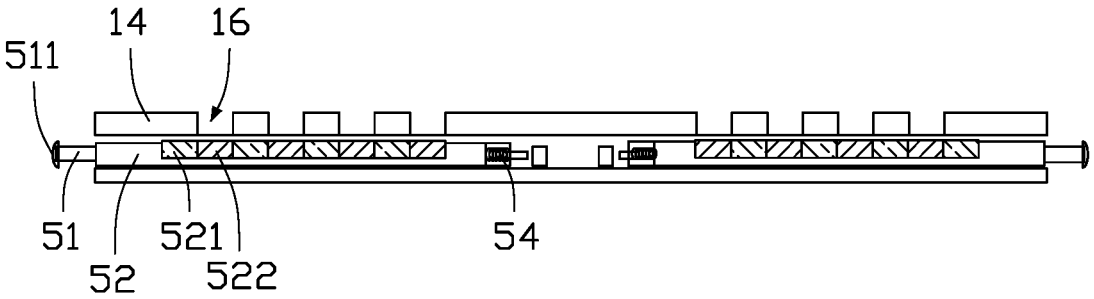
FIG. 4 is a schematic diagram of a structure of a display member in the material loading device.

FIG. 4 shows a structure of the display member 52. The display member 52 is coupled to the thimble 51. The display member 52 is provided with different colored areas. The main body 10 defines a plurality of recesses 16 in the wall 14 corresponding to the display member 52. The display member 52 is driven by the thimble 51 to slide relative to the recesses 16 to switch the colored areas displayed in the recesses 16. In one embodiment, the display member 52 includes first colored areas 521 and second colored areas 522. The first colored areas 521 and the second colored areas 522 are arranged at intervals on a surface of the display member 52. When the buckle rod 20 is not buckled into the buckle groove 121, one of the first colored areas 521 and the second colored areas 522 is displayed through the recesses 16. When the buckle rod 20 is buckled into the buckle groove 121, the buckle rod 20 pushes the thimble 51, and the thimble 51 drives the display member 52 to slide, so that the other one of the first colored areas 521 and the second colored areas 522 is displayed through the recesses 16.

The foolproof mechanism 50 further includes a linkage mechanism 53, which includes a lever 531 and a push rod 532. The lever 531 is rotationally coupled to the main body 10. One end of the lever 531 is movably coupled to the thimble 51, and another end of the lever 531 is movably coupled to the push rod 532. The thimble 51 drives the lever 531 to drive the push rod 532 into or away from the handle 41 of the handle mechanism 40 to hold or release the handle 41. In one embodiment, one end of the lever 531 is hinged to the thimble 51 through a connecting rod 533, and another end of the lever 531 is hinged to the push rod 532. In one embodiment, the buckle portion 411 of the handle 41 defines a buckle hole 412. When the handle 41 falls to the surface of the main body 10, the buckle portion 411 extends into the wall 14 through the groove 142 (shown in FIG. 1), and the buckle hole 412 faces the push rod 532. The lever 531 is driven by the thimble 51 to drive the push rod 532 into or away from the buckle hole 412.

The foolproof mechanism 50 further includes a reset member 54. One end of the reset member 54 is fixed to the main body 10, and another end of the reset member 54 resists against the thimble 51 toward an outer side of the buckle groove 121, so that when the thimble 51 is not subject to an external force, that is, when the buckle rod 20 is not buckled into the buckle groove 121, the push rod 532 is inserted into the buckle hole 412 under a driving force of the lever 531, so that the handle 41 cannot be lifted, thereby preventing an operator from forgetting to buckle the buckle rods 20. In one embodiment, the reset member 54 is arranged at an end of the sliding channel 141 away from the buckle groove 121. In one embodiment, the reset member 54 is a spring.

Figure 5:
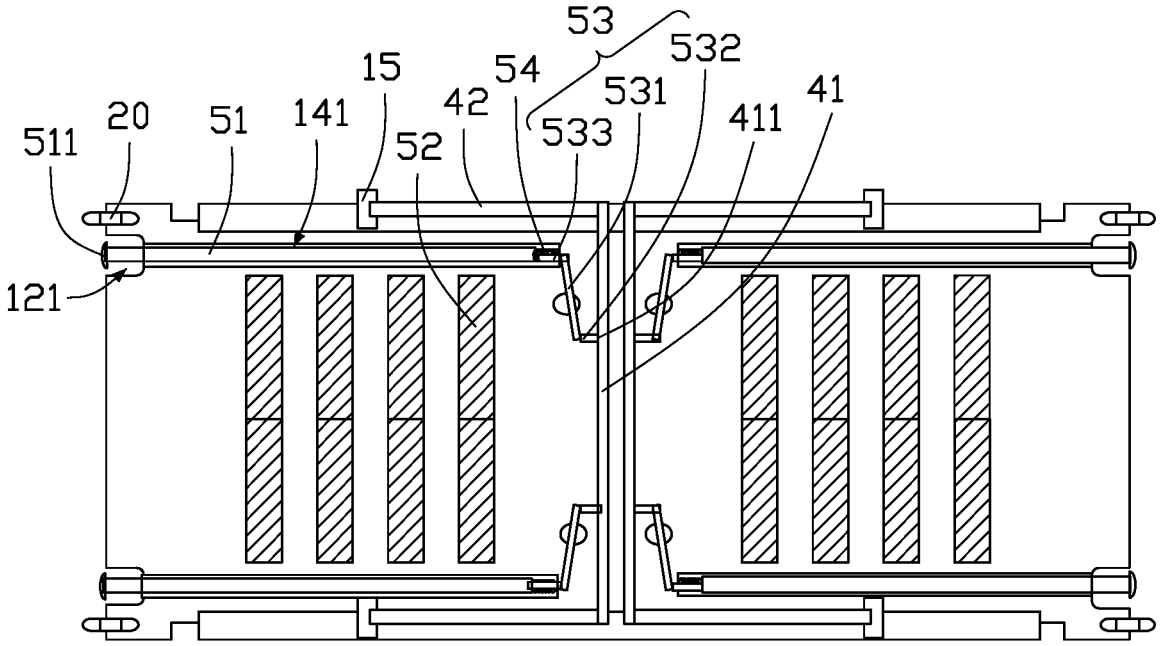
FIG. 5 is a schematic diagram of a structure of the foolproof mechanism when the material loading device is buckled.

FIG. 5 shows a structure of the foolproof mechanism 50 when the material loading device 100 is buckled. When the buckle rod 20 is not buckled into the buckle groove 121, the reset member 54 resists the thimble 51 toward the outer side of the buckle groove 121, the display member 52 displays one of the two colored areas through the recesses 16, and the push rod 532 is inserted into the buckle hole 412 under the driving force of the lever 531 so that the handle 41 cannot be lifted. When the buckle rod 20 is buckled into the buckle groove 121, the buckle rod 20 drives the thimble 51 to slide relative to the main body 10 through the limiting portion 511, the display member 52 slides relative to the recesses 16 under the driving force of the thimble 51 to display the other one of the two colored areas through the recesses 16, and the push rod 532 is moved away from the buckle hole 412 under the driving force of the lever 531, so that the handle 41 can be lifted. The colored area displayed through the recesses 16 and the locking state of the handle 41 remind the operator to buckle the buckle rods 20, thereby preventing the loading plates 30 in the main body 10 from falling out.

Compared with the related art, a transportation efficiency and stability of the material loading device 100 is improved.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A material loading device comprising:

a main body defining a receiving cavity and an opening communicating with the receiving cavity, the receiving cavity configured for receiving materials, the main body further defining a buckle groove at the opening;

a buckle rod movably coupled to the main body at the opening and configured to buckle into the buckle groove to resist against the materials in the receiving cavity; and a foolproof mechanism arranged on the main body; wherein:

the foolproof mechanism comprises a thimble and a display member;

the thimble is slidably coupled to the main body;

one end of the thimble is located in the buckle groove;

when the buckle rod is buckled into the buckle groove, the buckle rod drives the thimble to slide relative to the main body;

the display member is coupled to the thimble;

the display member has different colored areas;

the main body defines a plurality of recesses corresponding to the display member; and the thimble drives the display member to slide relative to the recesses to switch the colored areas displayed through the recesses.

2. The material loading device of claim 1, further comprising a handle mechanism movably coupled to the main body, wherein:

the foolproof mechanism further comprises a linkage mechanism, the linkage mechanism comprises a lever and a push rod;

the lever is rotationally coupled to the main body;

one end of the lever is movably coupled to the thimble, and another end of the lever is movably coupled to the push rod;

the thimble drives the lever to drive the push rod to hold or release the handle.

3. The material loading device of claim 2, wherein:

the foolproof mechanism further comprises a reset member;

one end of the reset member is fixed to the main body, and another end of the reset member resists against the thimble toward an outer side of the buckle groove.

4. The material loading device of claim 3, wherein:

a sliding channel communicating with the buckle groove is defined in a wall of the main body;

the thimble is slidably received in the sliding channel; and the reset member is arranged at an end of the sliding channel away from the buckle groove.

5. The material loading device of claim 4, wherein:

an end of the thimble located in the buckle groove comprises a limiting portion; and the limiting portion protrudes radially outward to limit a sliding distance of the thimble in the sliding channel.

6. The material loading device of claim 2, wherein:

the handle mechanism comprises a handle and two connecting rods respectively coupled to two ends of the handle;

the main body comprises two oppositely facing connecting seats; and an end of each connecting rod away from the handle is rotationally coupled to the corresponding connecting seat.

7. The material loading device of claim 6, wherein:

the handle comprises a buckle portion;

the buckle portion defines a buckle hole; and the lever is driven by the thimble to drive the push rod into or away from the buckle hole.

8. The material loading device of claim 7, wherein:

the connecting seat comprises two clamping plates arranged at an angle;

a distance between the two clamping plates gradually decreases along a direction from a surface of the main body to away from the main body; and the connecting rod is rotationally coupled between the two clamping plates.

9. The material loading device of claim 1, further comprising a plurality of loading plates, wherein:

the material loading plates are adapted to carry the materials;

two opposite inner walls of the main body define a plurality of slots;

two sides of each of the loading plates are respectively inserted into the corresponding slots on the two opposite inner walls; and the buckle rod is used to resist against the loading plates inserted into the slots.

10. The material loading device of claim 1, wherein:

the display member comprises two colored areas;

the two colored areas are arranged on a surface of the display member at intervals;

the recesses are arranged on the main body at intervals;

one of the two colored areas is displayed through the recesses when the buckle rod is not buckled; and another one of the two colored areas is displayed through the recesses when the buckle rod is buckled.

11. A material loading device comprising:

a main body defining a receiving cavity and at least one opening communicating with the receiving cavity, the receiving cavity receiving materials, the main body further defining at least one buckle groove at the opening;

a buckle rod movably coupled to the main body at the opening and configured to buckle into the buckle groove to resist against the materials in the receiving cavity;

a foolproof mechanism arranged on the main body; and a handle assembly arranged on the main body, the handle assembly comprising a handle and two connecting rods respetively coupled to two ends of the handle, wherein:

the main body comprises two oppsitely facing connecting seats, each connecting seat comprises two clamping plates arranged at an angle, a distance between the two clamping plates decreases along a direction from a surface of the main body to away from the main body, an end of each connecting rod is rotationally coupled between the two clamping plates;

when the buckle rod is buckled into the buckle groove, the foolproof mechanism displays one of a first colored area and a second colored area to indicate that the buckle rod is buckled into the buckle groove;

when the buckle rod is not buckled into the buckle groove, the foolproof mechanism displays the other one of the first colored area and the second colored area to indicate that the buckle rod is not buckled into the buckle groove; and when an external force is not applied to the handle, the handle falls to a surface of the main body.

* * * * *